US005462456A

United States Patent [19]

Howell

[11] Patent Number: 5,462,456

[45] Date of Patent: Oct. 31, 1995

[54] CONTACT RETENTION DEVICE FOR AN ELECTRICAL CONNECTOR

[75] Inventor: David G. Howell, Madison, N.C.

[73] Assignee: The Whitaker Corporation, Wilmington, Del.

[21] Appl. No.: 321,335

[22] Filed: Oct. 11, 1994

[51] Int. Cl.[6] ..... H01R 13/41

[52] U.S. Cl. ..... 439/733.1

[58] Field of Search ..... 439/733.1, 869

[56] References Cited

U.S. PATENT DOCUMENTS

| | | | |
|---|---|---|---|
| Re. 26,692 | 10/1969 | Ruehlemann | 439/637 |
| 3,231,848 | 1/1966 | Ruehlemann | 439/637 |
| 3,348,191 | 10/1967 | Kinkaid | 439/637 |
| 3,392,366 | 7/1968 | Nakazawa | 439/745 |
| 3,530,422 | 9/1970 | Goodman | 439/733 |
| 4,017,143 | 4/1977 | Knowles | 439/873 |
| 4,286,837 | 9/1981 | Yasutake et al. | 439/733 |
| 4,734,060 | 3/1988 | Kawawada et al. | 439/660 |
| 5,116,263 | 5/1992 | Bennett et al. | 439/733 |
| 5,236,368 | 8/1993 | Adams et al. | 439/79 |

*Primary Examiner*—Gary F. Paumen
*Attorney, Agent, or Firm*—Robert J. Kapalka

[57] ABSTRACT

A contact retention device for an electrical connector comprises a dielectric housing (12) having a cavity (18) with opposed first and second walls (30, 32). A recess (34) in the first wall (30) has side walls (35) which define corners (36) with the first wall. A contact (40) has a retention section (46) configured for insertion into the cavity (18). The retention section (46) has a base surface (54) which resides against the second wall (32) of the cavity. An oppositely facing surface (56) of the retention section has an embossment (58) with non-parallel side surfaces (60) which engage the corners (36) of the cavity in an interference fit, thereby retaining the contact in the connector.

7 Claims, 7 Drawing Sheets

CONTACT RETENTION DEVICE FOR AN ELECTRICAL CONNECTOR

FIELD OF THE INVENTION

The invention relates to a device for retaining contacts in an electrical connector with an interference fit whereby forces resulting from the interference fit are distributed throughout the structure of the connector housing.

BACKGROUND OF THE INVENTION

A socket for electrically connecting a daughtercard such as a single in-line memory module (SIMM) or a dual in-line memory module (DIMM) to a mothercard comprises an elongated housing having electrical contacts arrayed along its length. The contacts are typically made by edge stamping metallic strip material. The contacts may be stamped as blanks which are then bent or formed to a desired shape before insertion into the socket. Alternatively, the contacts may be stamped in their final configuration ready for insertion into the socket. In either case, the contacts are typically retained in cavities in the socket housing by an interference fit between side edges of the contacts and walls of the cavities. The side edges of the contacts may include pointed projections or barbs which dig into and grip the walls, but in any case forces which are exerted on the walls due to the interference fit must be absorbed by the housing.

Contacts of the blanked and formed variety are typically inserted into the connector housing with the plane of each contact aligned longitudinally in the connector. Forces arising from the interference fit are thus directed longitudinally in the connector housing, and a summation of the forces from all of the contacts tends to bow the connector housing, thereby causing gaps between the socket and the mothercard. Contacts of the stamped in final shape variety are typically inserted into the housing with the plane of each contact projecting laterally across the longitudinally extending connector. Side walls of the connector housing may be relatively thin, and the force fitted contacts can cause cracks in the side walls. The present invention overcomes these problems by providing a device to retain contacts in a connector with an interference fit while distributing stresses more evenly in the connector housing.

SUMMARY OF THE INVENTION

It is an object of the invention to improve the retention of contacts in an electrical connector.

It is another object of the invention to minimize the accumulation of contact retention forces in any given direction in an electrical connector.

It is a further object of the invention to improve the distribution of stresses throughout an electrical connector housing.

These and other objects are accomplished by an electrical connector comprising:

a dielectric housing having a plurality of cavities, each of the cavities extending inwardly from an exterior face of the housing and having opposed first and second walls, each of the first walls having a selected length in a common first direction substantially parallel to the exterior face of the housing, each of the first walls having a recess therein, each of the recesses having a selected length in the first direction which is less than the selected length of its respective said first wall, the recesses each having side walls which define corners where the side walls intersect their respective said first wall; and, a plurality of contacts disposed in respective ones of the cavities, each of the contacts having a retention section including a base surface in abutment with the second wall of its respective said cavity and an oppositely facing surface having an embossed section defining non-parallel side surfaces in engagement with the housing at the corners of its respective said cavity in an interference fit, whereby forces retaining the contact in the housing are angled non-orthogonally with respect to the first direction, thereby minimizing accumulation of said retention forces in any given direction.

BRIEF DESCRIPTION OF THE DRAWINGS

The invention will now be described by way of example with reference to the accompanying drawings in which like elements in different figures thereof are identified by the same reference numeral and wherein.

DETAILED DESCRIPTION OF THE PREFERRED EMBODIMENT

Figure 1:
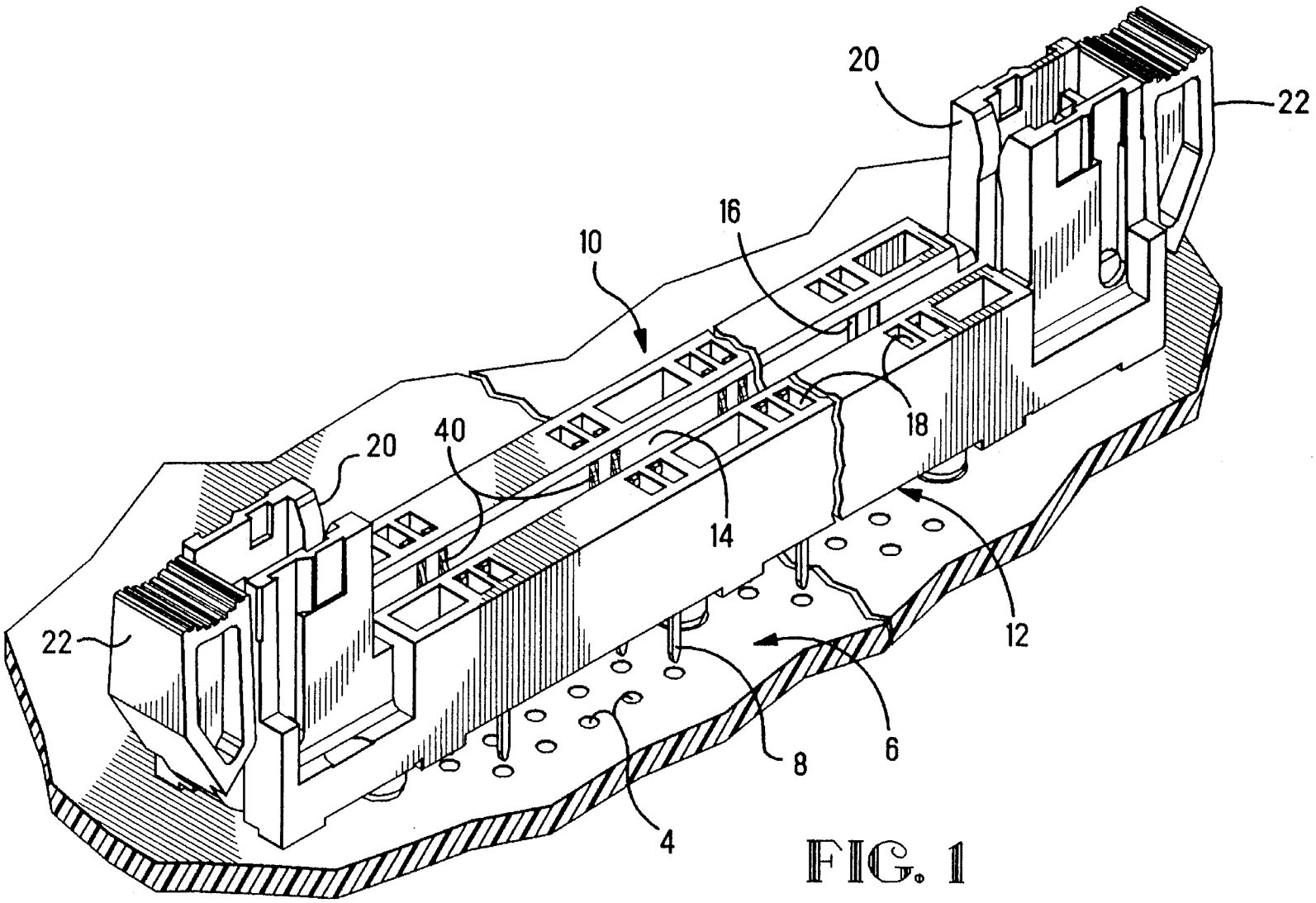
FIG. 1 is an isometric view of an electrical connector which incorporates a contact retention device according to the invention.
Figure 2:
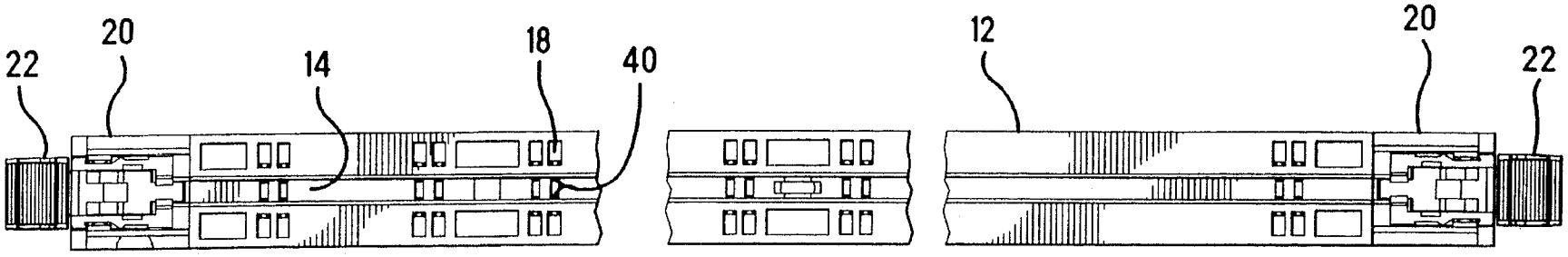
FIG. 2 is a top plan view of the electrical connector.
Figure 3:
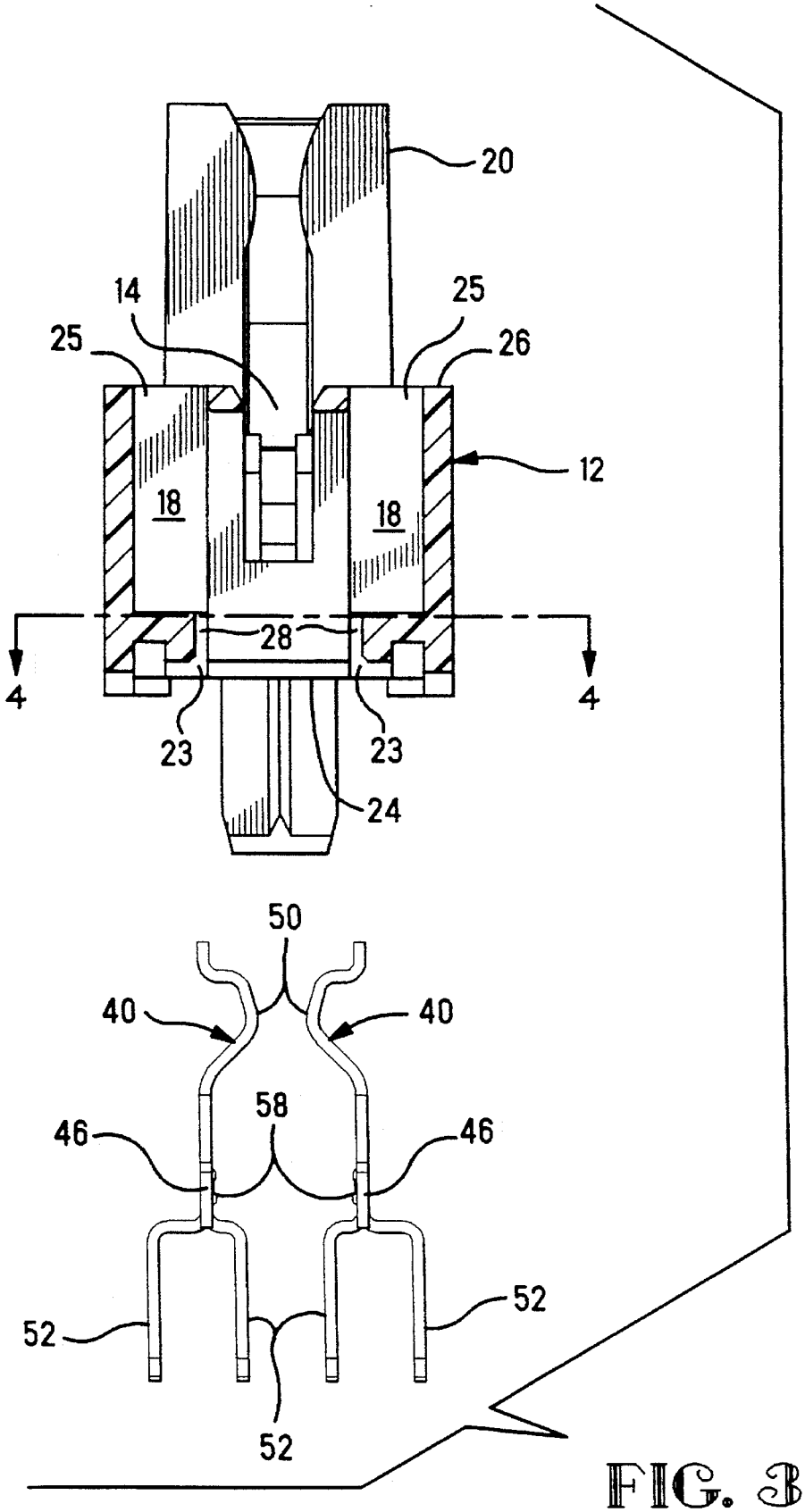
FIG. 3 is a cross-sectional view of the electrical connector with contacts exploded away.

Referring to FIGS. 1–3, the invention my be embodied in an electrical connector such as dual in-line memory module (DIMM) socket 10 comprising a dielectric housing 12 having an elongated slot 14 which is dimensioned to receive an edge portion of a circuit panel daughtercard (not shown) therein. Contacts 40 reside in respective cavities 18 in the housing 12 and are disposed in two parallel rows on opposite sides of the slot 14. The contacts 40 extend through recesses 16 into the slot 14 for electrical engagement with contact pads on the daughtercard. The contacts 40 include respective leads 8 which project downwardly from the housing 12 for insertion and solder connection in plated through-holes 4 of a mothercard 6, thereby electrically interconnecting the contacts 40 to the mothercard. The socket 10 further has a pair of card guides 20 which stabilize the daughtercard in the socket, and a pair of pivotable ejectors 22 which are operable to dislodge the daughtercard from within the slot 14.

As shown in FIG. 3, the cavities 18 extend inwardly from openings 23 in bottom face 24 of the housing 12. The cavities 18 are shown as extending fully from the openings 23 to openings 25 in top face 26; however, the contacts 40 are insertable into their respective cavities 18 through the openings 23, and a connector according to the invention may be constructed without the openings 25.

Figure 4:
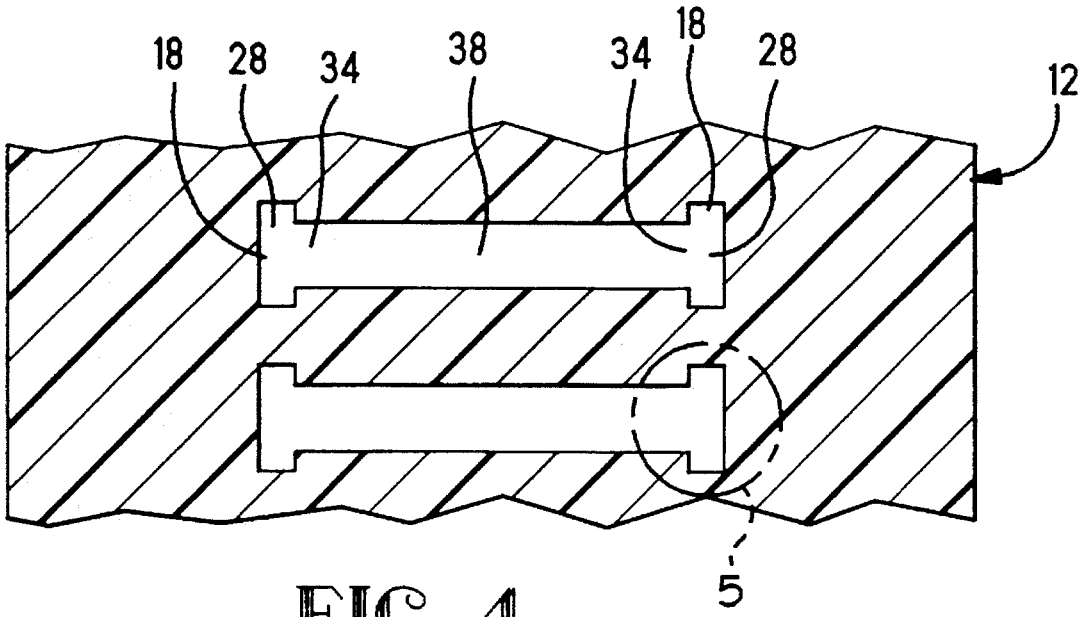
FIG. 4 is a cross-sectional view through the connector taken along line 4—4 of FIG. 3.
Figure 5:
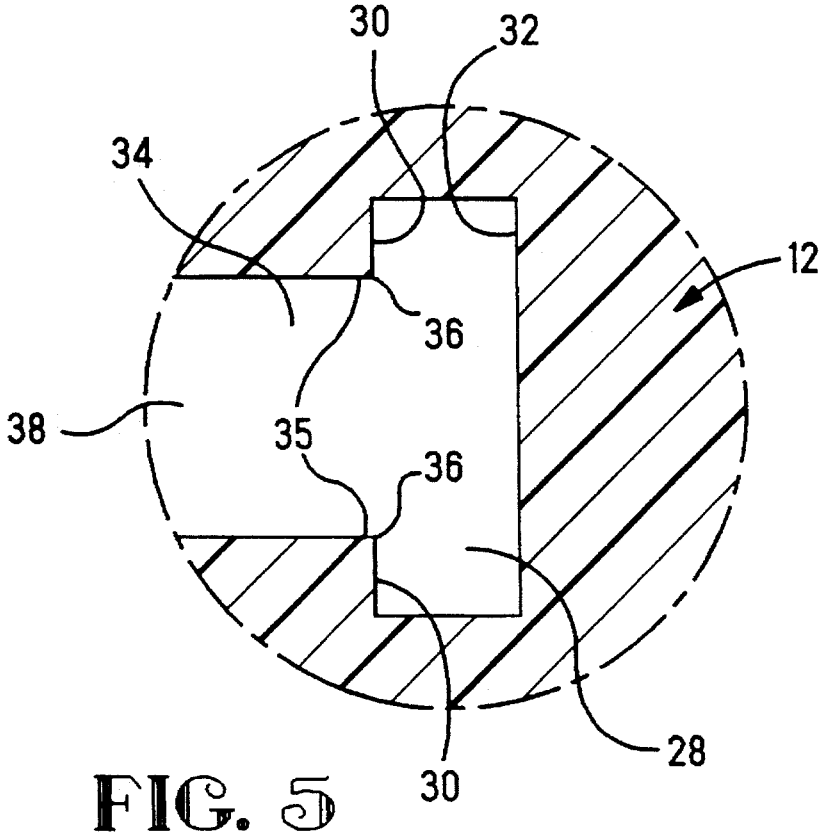
FIG. 5 is enlarged detail of FIG. 4.

Referring to FIGS. 3–5, each of the cavities 18 has a retention chamber 28 which is configured to receive a retention section 46 of one of the contacts 40 in a close fit, thereby retaining the contact 40 in its cavity 18. As best seen in the enlarged view of FIG. 5, the retention chamber 28 has a first wall 30 and an opposed second wall 32. The first wall 30 has a selected length in a first direction which is parallel to the bottom face 24 of the housing, and all of the first walls 30 are aligned so that they share the first direction in common. A recess 34 in the first wall 30 has a selected length in the first direction which is less than the selected length of the first wall 30. The recess 34 has respective side walls 35 which define respective corners 36 where the side walls 35 intersect the first wall 30. As shown in FIG. 4, the recesses 34 of opposed pairs of the cavities 18 are open to each other through channel 38 which extends transversely beneath the slot 14.

Figure 6:
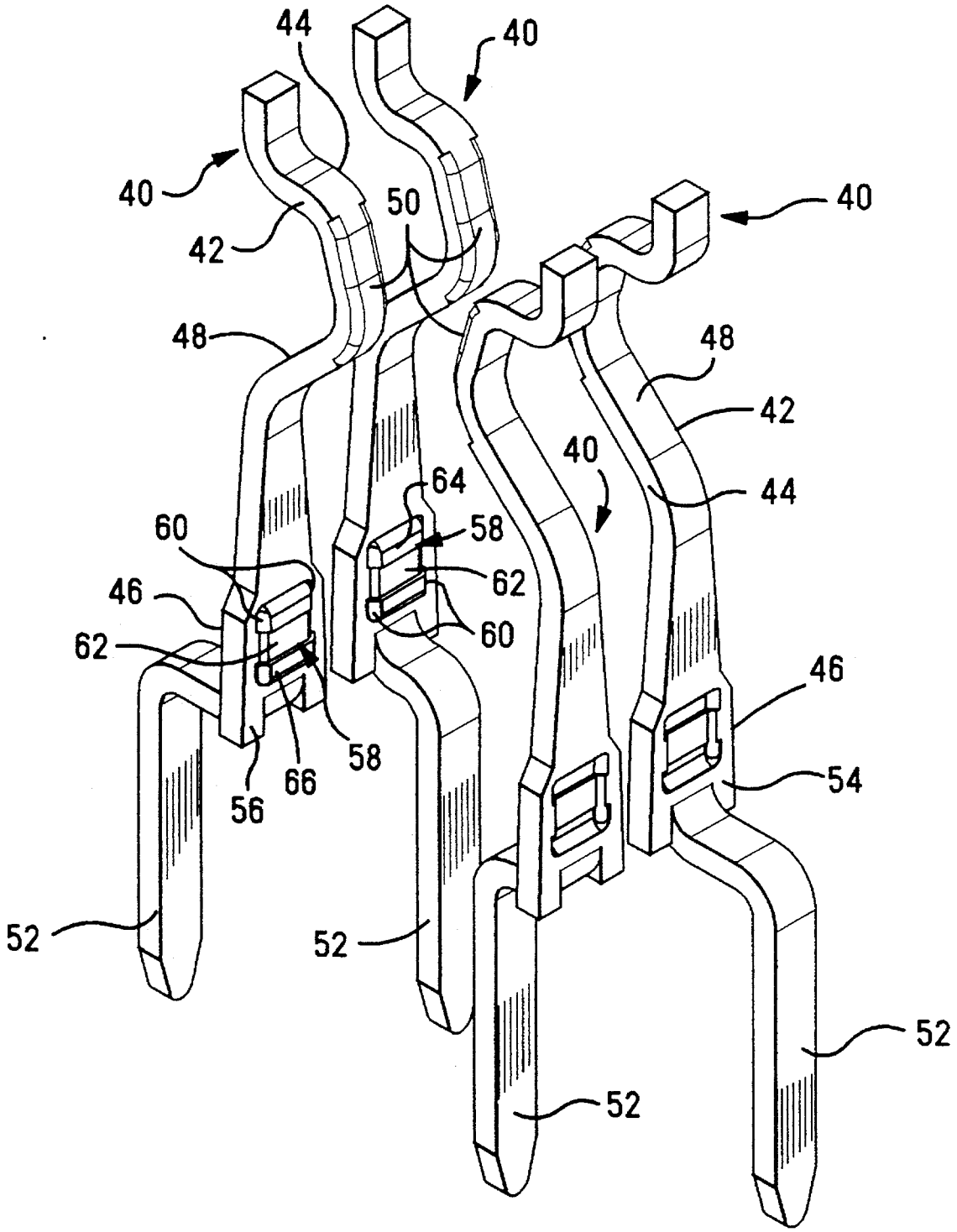
FIG. 6 is an isometric view of contacts used in the connector.
Figure 7:
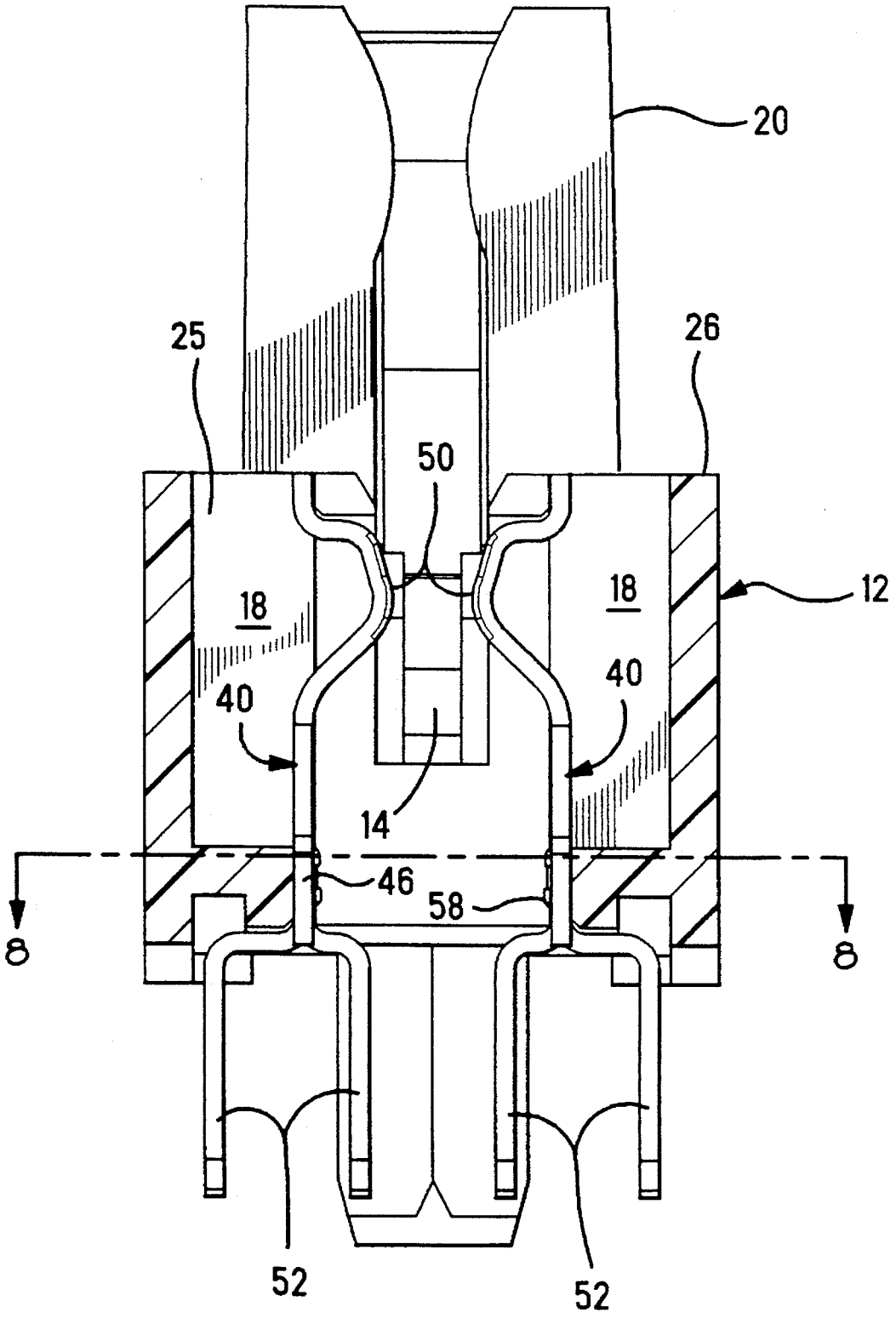
FIG. 7 is a cross-sectional view similar to FIG. 3 with the contacts disposed in the connector.

Opposed pairs of the contacts 40 are shown in FIG. 6. The contacts 40 are edge stamped along their respective side edges 42 and 44 from a strip of appropriate electrically conductive material and then bent and formed to a desired shape. Each of the contacts 40 has a retention section 46 which is a formed planar portion of the material strip. A contact arm 48 extends upwardly from the retention section 46 and is formed with bends to provide a card engaging surface 50 which projects through the recess 16 into the slot 14, as shown in FIG. 7. The bends in the contact arm 48 contribute to flexibility of the arm in the horizontal and vertical directions. Leg 52 extends from the retention section and is bent downwardly to provide the lead 8 which engages in the plated through-hole 4 of the mothercard 6, as shown in FIG. 1.

Referring now to FIGS. 4–6, the retention section 46 is configured for insertion between the first and second walls 30, 32 in the retention chamber 28 of one of the cavities 18. The retention section 46 includes a base surface 54 associated with the second wall 32, and an oppositely facing surface 56 having an embossed section 58 associated with the recess 34. The embossed section 58 is formed by pressing or impacting the substantially planar retention section 46 so that a portion of the retention section 46 is extruded above the plane of the oppositely facing surface 56. A configuration of the embossed section 58 is selected to provide non-parallel side surfaces 60 each associated with one of the corners 36 of the cavity 18. In a preferred embodiment the embossed section 58 includes a raised surface 62 with a projecting hood 64 and projecting base 66, and the non-parallel side surfaces 60 are defined by beveled sides of the projecting hood 62 and base 64.

Figure 8:
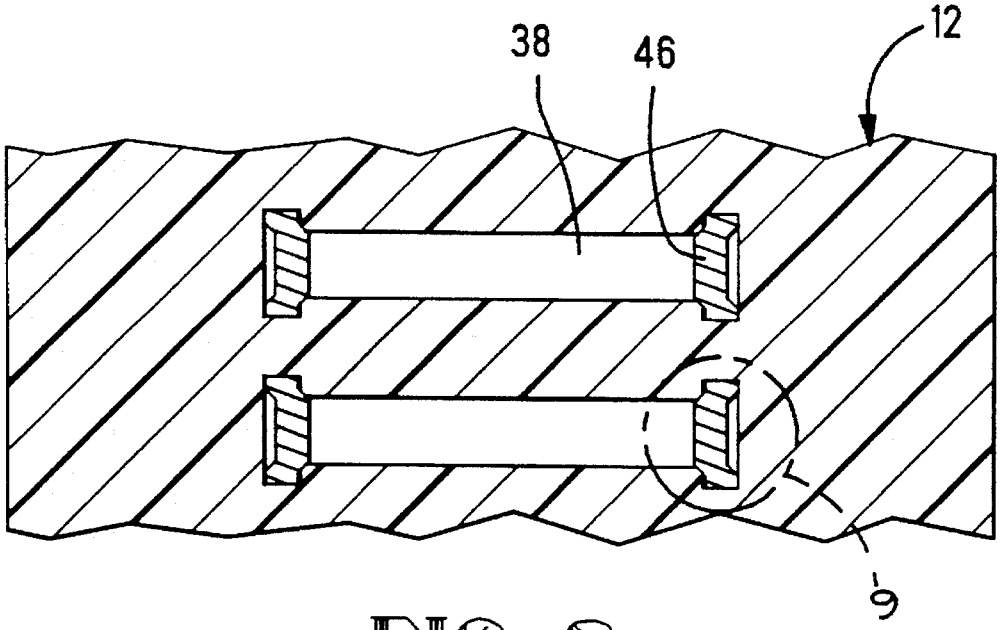
FIG. 8 is a cross-sectional view through the connector taken along line 8—8 of FIG. 7.
Figure 9:
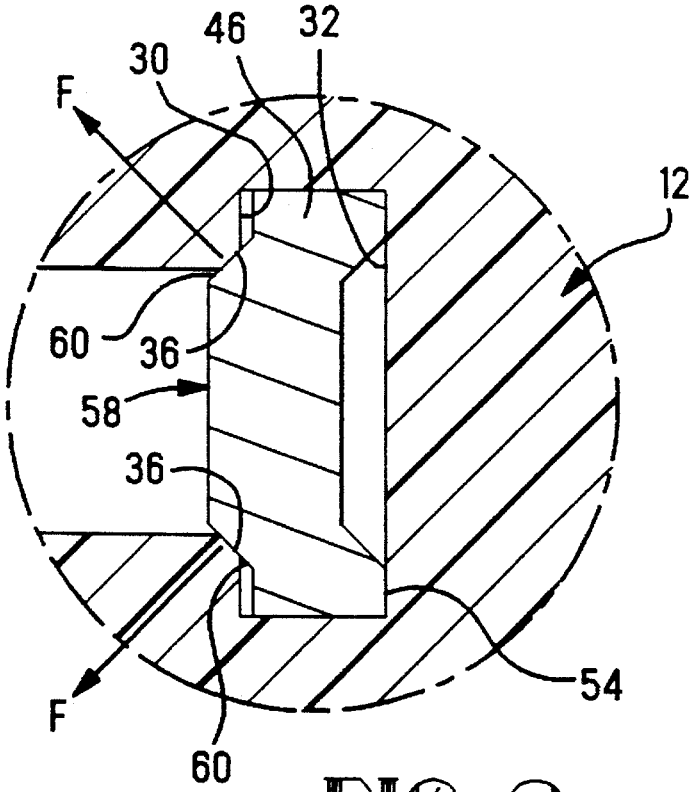
FIG. 9 is an enlarged detail of FIG. 8.

The contacts 40 are inserted upwardly into their respective cavities 18 until they reside in position as shown in FIG. 7. In this position the retention section 46 cooperates with walls of the cavity 18 to retain the contact in the housing. As seen in FIGS. 8 and 9, the base surface 54 of the retention section 46 is in abutment with the second wall 32 of the cavity 18, and the side surfaces 60 are in engagement with the housing 12 by an interference fit with the corners 36. The interference fit generates reaction forces on both the contact and the housing. As a result of the side surfaces 60 being non-parallel, reaction forces F on the housing 12 are angled non-orthoganally with respect to the plane of the first wall 20, thereby distributing the reaction forces throughout the housing 12 and minimizing accumulation of the reaction forces in any given direction. Reaction forces on the side surfaces 60 provide frictional resistance to withdrawal of the contacts 40 from the socket so as to retain the contacts 40 therein.

The invention has the advantage that reaction forces arising from an interference fit between a contact and its connector are distributed throughout the connector housing so as to reduce the peak reaction force in any given direction.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. A contact retention device for an electrical connector, comprising:

a dielectric housing having a cavity extending inwardly from an exterior face of the housing, the cavity having opposed first and second substantially parallel walls, the first wall having a selected length in a first direction substantially parallel to the exterior face of the housing, a recess in the first wall having a selected length in the first direction which is less than the selected length of the first wall, the recess having side walls which define corners where the side walls intersect the first wall; and, a contact having a retention section configured for insertion into the cavity from the exterior face of the housing, the retention section including a base surface associated with the second wall and an oppositely facing surface having an embossed section associated with the recess, the embossed section defining non-parallel side surfaces associated with the corners such that, upon insertion of the contact into the cavity, the base surface is in abutment with the second wall and the side surfaces are in engagement with the housing at said corners in an interference fit, thereby retaining the contact in the housing.

2. The contact retention device according to claim 1, wherein the contact comprises a bent strip of planar material.

3. The contact retention system according to claim 2, wherein the retention section is a planar portion of the strip with the embossed section thereon.

4. An electrical connector, comprising:

a dielectric housing having a plurality of cavities, each of the cavities extending inwardly from an exterior face of the housing and having opposed first and second substantially parallel walls, each of the first walls having a selected length in a common first direction substantially parallel to the exterior face of the housing, each of the first walls having a recess therein, each of the recesses having a selected length in the first direction which is less than the selected length of its respective said first wall, the recesses each having side walls which define corners where the side walls intersect their respective said first wall; and, a plurality of contacts disposed in respective ones of the cavities, each of the contacts having a retention section including a base surface in abutment with the second wall of its respective said cavity and an oppositely facing surface having an embossed section defining non-parallel side surfaces in engagement with the housing at the corners of its respective said cavity in an interference fit, whereby forces retaining the contact in the housing are angled non-orthogonally with respect to the first direction, thereby minimizing accumulation of said retention forces in any given direction.

5. The connector according to claim 4, wherein the plurality of cavities are arrayed in at least one row.

6. The connector according to claim 4, wherein each of the contacts comprises a bent strip of planar material.

7. The connector according to claim 6, wherein the retention section of each contact is a planar portion of the strip with the embossed section thereon.

* * * * *